United States Patent [19]

Olsson

[11] Patent Number: 4,478,471

[45] Date of Patent: Oct. 23, 1984

[54] ZERO INSERTION FORCE CONNECTOR HAVING IMPROVED CAMS

[75] Inventor: Billy E. Olsson, New Cumberland, Pa.

[73] Assignee: AMP Incorporated, Harrisburg, Pa.

[21] Appl. No.: 590,550

[22] Filed: Mar. 19, 1984

Related U.S. Application Data

[63] Continuation of Ser. No. 344,440, Feb. 1, 1982, abandoned.

[51] Int. Cl.[3] ..... H01R 9/09

[52] U.S. Cl. ..... 339/74 R; 339/176 MP

[58] Field of Search ..... 339/75 MP, 74 R, 176 MP

[56] References Cited

U.S. PATENT DOCUMENTS

| | | | |
|---|---|---|---|
| 3,537,063 | 10/1970 | Beaulieu | 339/74 R |
| 3,638,167 | 1/1972 | Occhipinti et al. | 339/74 R |
| 3,818,419 | 6/1974 | Crane | 339/74 R |
| 3,899,234 | 8/1975 | Yeager et al. | 339/74 R |
| 4,076,362 | 2/1978 | Ichimura | 339/75 MP |
| 4,159,154 | 6/1979 | Arnold | 339/74 R |
| 4,176,900 | 12/1979 | Hines et al. | 339/75 MP |
| 4,257,660 | 3/1981 | Chalmers | 339/74 R |
| 4,270,826 | 6/1981 | Narozny | 339/75 MP |
| 4,341,433 | 7/1982 | Cherian et al. | 339/17 CF |
| 4,367,006 | 1/1983 | Rehbogen, Jr. et al. | 339/17 F |

OTHER PUBLICATIONS

"A New Zero Insertion Force Connector", Jerry B. Mintor, Thirteenth Annual Connector Symposium, Oct. 8-9, 1980.

*Primary Examiner*—John McQuade

*Attorney, Agent, or Firm*—F. W. Raring; Anton P. Ness

[57] ABSTRACT

Zero insertion force connector has a housing containing contact terminals which are moved into, and out of, engagement with terminal pads on circuit board by cams. The terminals have end portions which partially surround the cams and which are remote from the locations at which the terminals are gripped in the housing. The cams can be actuated with reduced forces by virtue of the long lever arms of the terminals.

14 Claims, 10 Drawing Figures

ZERO INSERTION FORCE CONNECTOR HAVING IMPROVED CAMS

This application is a continuation of application Ser. No. 344,440 filed Feb. 1, 1982 now abandoned.

FIELD OF THE INVENTION

This invention relates to zero insertion force electrical connectors and particularly to the improvement of the actuating cams for zero insertion force (ZIF) connectors which achieve a reduction in the force required to actuate the cams.

BACKGROUND OF THE INVENTION

A typical ZIF connector comprises an insulating housing having a trough-like recess into which the edge portions of a panel-like member, such as a circuit board, are inserted. The housing contains a plurality of contact terminals which have contact portions that engage conductors on the circuit board. A ZIF connector differs from a non-ZIF connector in that the ZIF connector has a cam or other device by means of which the terminals can be flexed or moved to positions such that they do not extend into the recess. The circuit board can thus be inserted into the connector under zero insertion force conditions. ZIF connectors are desirable for several reasons; the circuit board can obviously be inserted into the recess more easily under ZIF conditions than under circumstances where the circuit board must be pushed between the contact portions of the terminals in the housing. Additionally, when the circuit board is inserted into a non-ZIF connector, the contact portions of the terminals must slide over the conductors on the circuit board for a short distance and if the terminals are designed to exert high contact forces, the plating on the circuit board conductors will be damaged.

Known types of ZIF connectors usually have a cam that moves the terminals towards or away from the recess in the connector housing located relatively close to the fulcrum locations of the terminals, that is, close to the locations at which the terminals are fixed to the connector housing. The cam thus engages the terminal at the end of a fairly short lever arm and since the end portion of the terminal in which the contact is provided must be moved, a relatively high force may be required to move the cam. The force required to actuate the cam becomes excessively high if the connector contains a relatively large number of terminals, say 300 to 500 terminals, and if each terminal is designed to develop a contact force in excess of 125 grams. It is quite common to provide terminals in some connectors which develop contact force of 200 or more grams per terminal and it can readily be seen that a substantial force will be required to move the cam in a manner which will flex all of the terminals in the connector. These problems in the design of ZIF connectors become increasingly troublesome if the connector must be of reduced size and must have its contact terminals on closely spaced centers, for example, 1.27 mm. The present invention is directed to the achievement of ZIF connectors having improved terminals and cams which are such that the cams can be actuated by the application of a relatively low rotary or linear force to the cams, even when the connector contains a relatively large number of contact terminals.

A ZIF multi-contact electrical connector in accordance with the invention comprises an insulating housing having oppositely facing first and second major surfaces, oppositely facing endwalls, and oppositely facing sidewalls. The first major surface has a trough-like recess therein extending parallel to the sidewalls for reception of the edge portions of a panel-like member such as a circuit board. A plurality of side-by-side terminal receiving cavities are provided in the housing on each side of the recess and a contact terminal is positioned in each cavity. The terminals extend substantially to the second major surface and have contact portions which are proximate to the recess for contacting the conductors on the panel-like member. A camming rod or a pair of camming rods, extend through the connector housing and engage the terminals thereby to cause movement of the contact portions towards and away from the recess. A connector in accordance with the present invention is particularly characterized in that a camming rod is provided on each side of the recess adjacent to the first major surface of the housing. Each contact terminal is fixed to the housing at a fulcrum location adjacent to the second major surface, the contact portion of each terminal being adjacent to the first major surface. The contact terminals normally extend from the fulcrum locations partially into the recess so that the contact portions are normally in the recess. Each contact terminal has an end portion which extends laterally from the contact portion away from the recess and towards the associated sidewall, the end portion being between the first major surface and the associated camming rod. Cooperating camming means are provided on the end portions of the contact terminals and on the associated camming rod, the camming means being effective during movement in one direction to flex the terminals inwardly of their respective cavities so that the contact portions move from the recess into the cavities to permit insertion of the circuit board under ZIF conditions. Upon movement of the camming rods in the reverse direction, the opposite direction from the first direction, the terminals return towards their normal positions and the contact portions are resiliently biased against the conductors on the circuit board.

In accordance with a further embodiment, the end section of each contact terminal comprises a bight section and a tip section, the bight section extending past the associated camming rod and towards the adjacent housing sidewall and the tip section extending transversely of the bight section and being beside, and generally parallel to, the associated sidewall. The tip section and the bight section partially surround the associated camming rod and the camming means are on the tip section and on the adjacent portions of the camming rod.

In accordance with a further embodiment, on each side of the trough-like recess, alternate contact terminals have their contact portions closer to the first major surface of the housing than the contact portions of the remaining contact terminals so that the connector can be used with a panel-like member having conductors on staggered centers.

In accordance with further embodiments, the contact terminals are flat stamped members and the trough-like recess extends to, and intersects, at least one of the endwalls of the housing. In accordance with further embodiments, the camming rods are rotatable cylinders having chordal surface portions in alignment with each contact terminal and the camming rods are metallic rods provided with insulating coatings.

In accordance with further embodiments, the connector is intended for use with a circuit board having conductors on only one surface thereof, the connector having only one row of contact terminals instead of two rows.

PREFERRED EMBODIMENT OF THE INVENTION

Figure 1:
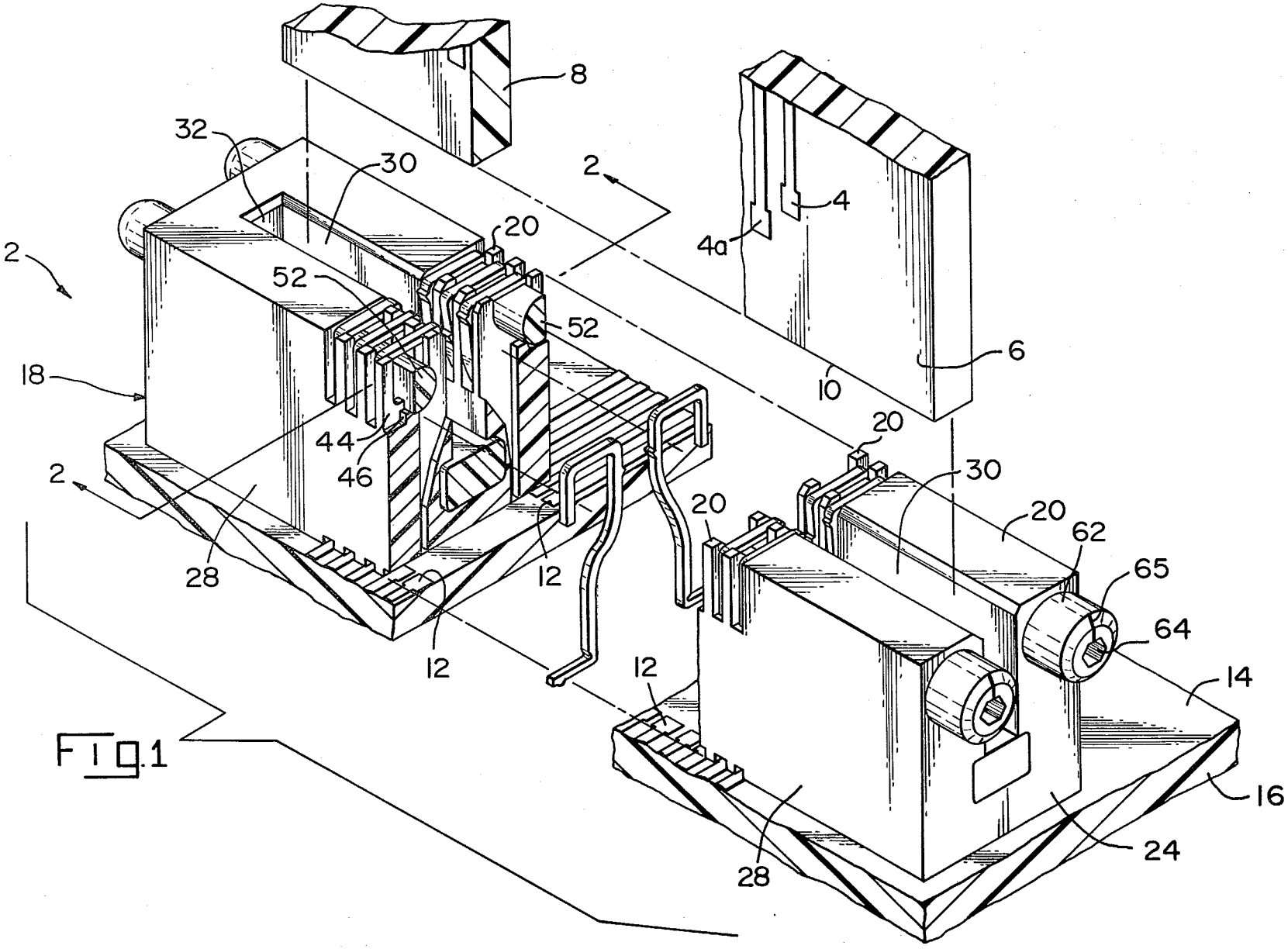
FIG. 1 is a perspective view with parts broken away of a connector in accordance with the invention mounted on a printed circuit mother board and showing a printed circuit daughter board exploded from the connector.

A connector 2, FIG. 1, in accordance with the invention serves to connect conductors in the form of terminal pads 4, 4*a* on the surfaces 6, 6′ of a first panel-like member 8 to conductors such as terminal pads 12 on the upper surface 14 of a second panel-like member 16. In FIG. 1, the panel member 16 is a mother board and the panel member 8 is a daughter board. The conductors 4, 4*a* are staggered as shown, with the conductors 4*a* being closer to the lower edge 10 of the panel than the conductors 4. This arrangement permits close spacing of the conductors 4, 4*a* but complicates the design of connectors for the panel 8.

The connector 2 comprises an insulating housing 18 having upper and lower major surfaces 20, 22, oppositely facing endwalls 24, 26, and oppositely facing sidewalls 28. A trough-like recess 30 extends into the upper major surface 20 and extends to the endwall 24. The lefthand end of this recess is closed by a barrier wall 32. The panel-like member 8 can thus be inserted into the recess 30 by moving the panel downwardly from the position shown or by aligning the panel with the end of the recess at the endwall 24 and sliding the panel laterally until it engages the wall 32.

Figure 4:
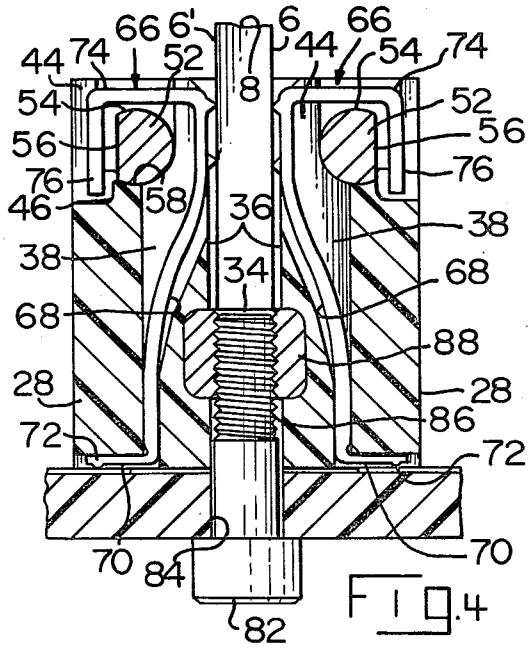
FIGS. 3 and 4 are views similar to FIG. 2 illustrating the manner in which the daughter board is inserted into the connector.
Figure 3:
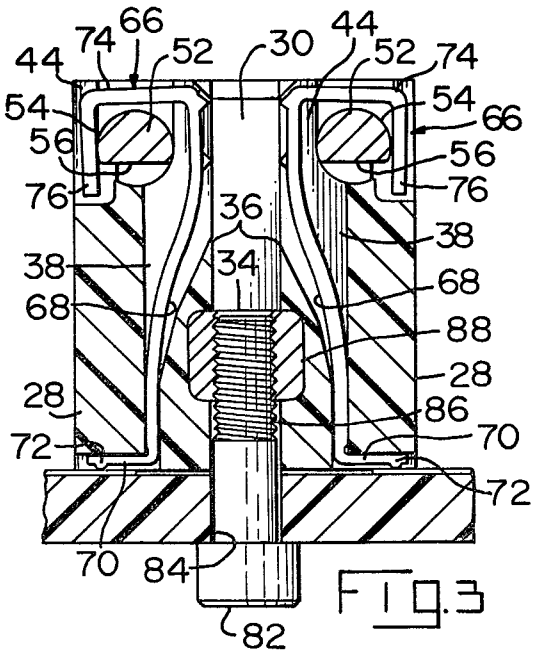
Figure 2:
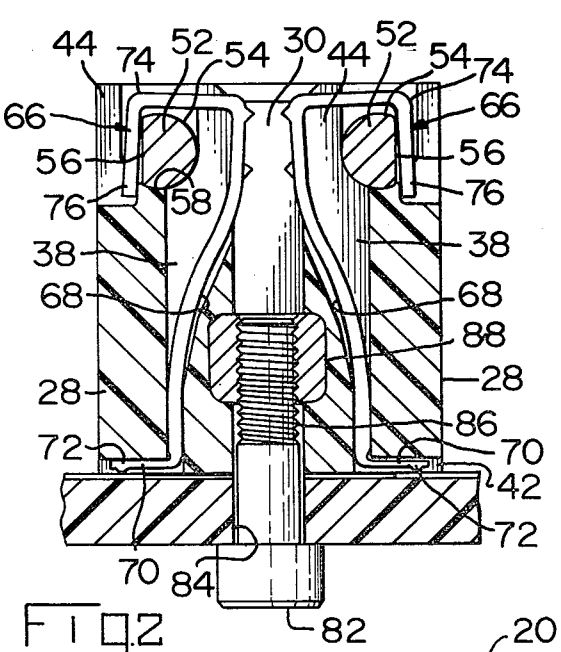
FIG. 2 is a cross-sectional view looking in the direction of the arrows 2—2 of FIG. 1.
Figure 6:
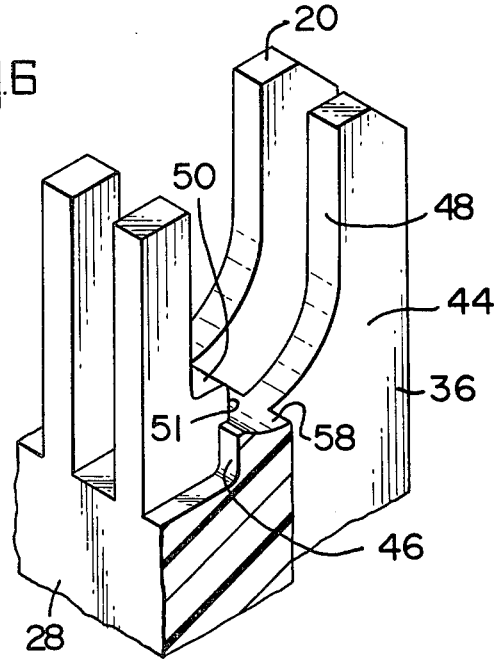
FIG. 6 is an enlarged fragmentary perspective view showing details of the upper portions of the terminal receiving cavities.

As shown in FIGS. 2–4, recess 30 has an inner end or floor 34 and opposed recess sidewalls 36. Terminal receiving cavities 38 extend into the sidewalls 36 in the upper portion of the housing and extend downwardly to the lower surface 22 where they merge with laterally extending slots 42. The lower portions of the cavities 38 are of reduced cross-section, as shown at 40, and receive portions of the contact terminals tightly, as will be described below. The upper portions 44 of the cavities are enlarged and extend laterally to the sidewalls 28 and to the upper major surface 20 as shown in FIG. 1. Each cavity has a shoulder 46 (FIG. 1) proximate to its associated sidewall 28 which faces outwardly towards the sidewall. The barrier walls between adjacent cavities have openings 48, FIG. 6, which extend inwardly from the upper surface 20 and which are contoured to provide an upwardly facing shoulder 50 between each pair of adjacent cavities. The surfaces of these openings 48 are arcuate, as shown at 58, the radius of curvature of these arcuate portions being equal to the radius of curvature of the camming rods, also described below. The openings are also contoured to provide inwardly facing shoulders 51.

The camming rods 52 extend through the housing between the endwalls 24, 26 and are supported for rotation adjacent to the endwalls and on the arcuate surfaces 58. The camming rods may be of steel or other high strength metal and have their surfaces coated, as shown at 54, with a tough durable insulating material, such as polyvinylidine fluoride so that the rods will be insulated from the contact terminals. The camming rods can also be of high strength non-magnetic material, either an insulator or a metal, if desired. The rods are cylindrical with a flat chordal surface 56 and can be rotated through an angle of 90° from the position shown in FIG. 2 to the position shown in FIG. 3. In FIG. 2, it will be apparent that the chordal surface of each rod is against the shoulders 51 (FIG. 6) while the chordal surface is against the shoulder 50 when the rods are in the position of FIG. 3.

Figure 5:
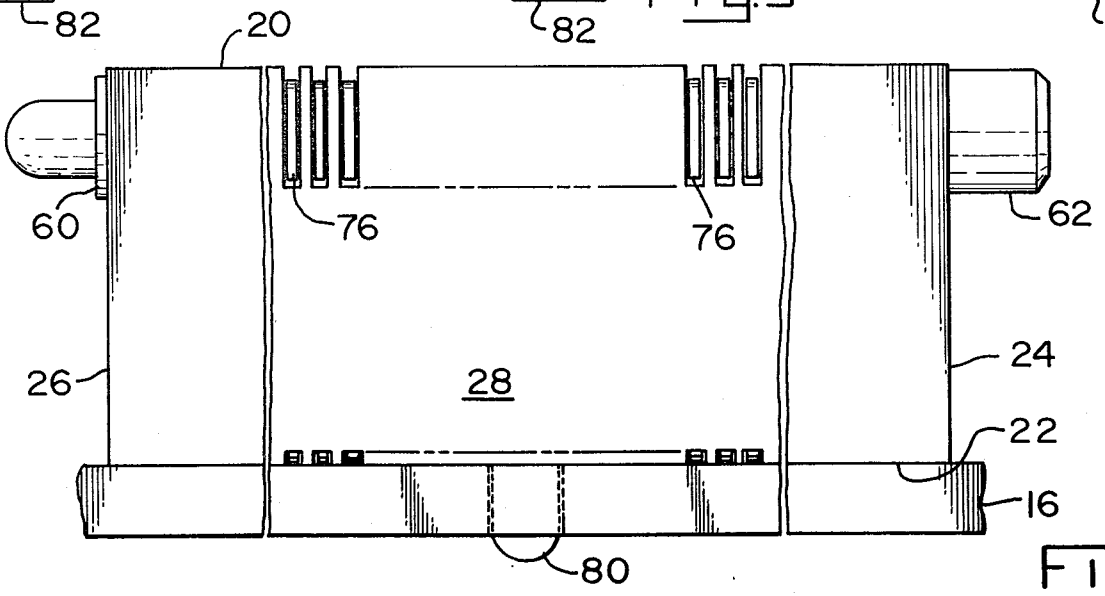
FIG. 5 is a side view of the connector.

The ends of the camming rods extend beyond the endwalls 24, 26 and the rods are restrained against axial movement by lock washers 60, FIG. 5, on the ends which extend beyond the endwall 26. The camming rods have enlarged ends 62 at the endwall 24 of the housing and these enlarged ends are provided with hexagonal recesses 64 for reception of a wrench. It is desirable to provide an indicator marking 65 on the end of each camming rod to indicate the rotary positions of the rods.

Figure 9:
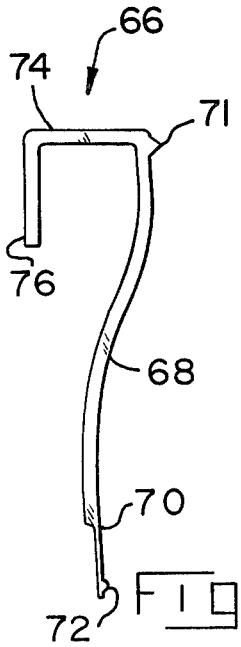
FIGS. 9 and 10 are plan views of the two types of terminals used in the connector, the terminals being shown in their "as stamped" condition and prior to insertion into the connector housing.
Figure 10:
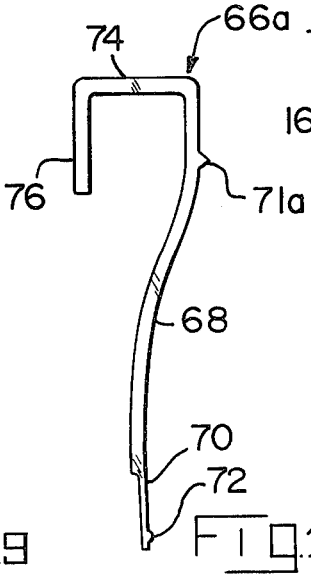

The contact terminals 66, 66*a* which are contained in the cavities 38 are manufactured as flat stamped members of a suitable spring material, as shown in FIGS. 9 and 10, with all of the parts of each contact terminal lying in the plane of the stock metal from which the terminal was produced. Each terminal 66 has a relatively elongated spring arm portion 68 and a lower end 70 of reduced width on the end of which there is a second contact portion 72 that engages one of the conductors 12. A first contact portion is provided immediately adjacent to the upper end of the arm 68 as shown at 71. The terminal 66 also has a laterally extending bight section 74 and a depending tip section 76 which is substantially parallel to the upper end of the spring arm. The portions 74 and 76 of the terminal 66 constitute the end section of the terminal which cooperates with the associated camming rod as described below.

The terminal 66*a* is similar to the terminal 66 excepting that the first contact portion 71*a* is spaced from the upper end of the terminal. As is apparent from FIG. 1, alternate cavities 38 on each side of the recess contain terminals of the type shown at 66 and these terminals engage the conductors 4 on the panel 8. The remaining cavities contain terminals of the type shown at 66*a* and the contact portions 71*a* of these terminals engage the conductors 4*a* of the panel 8.

Figure 7:
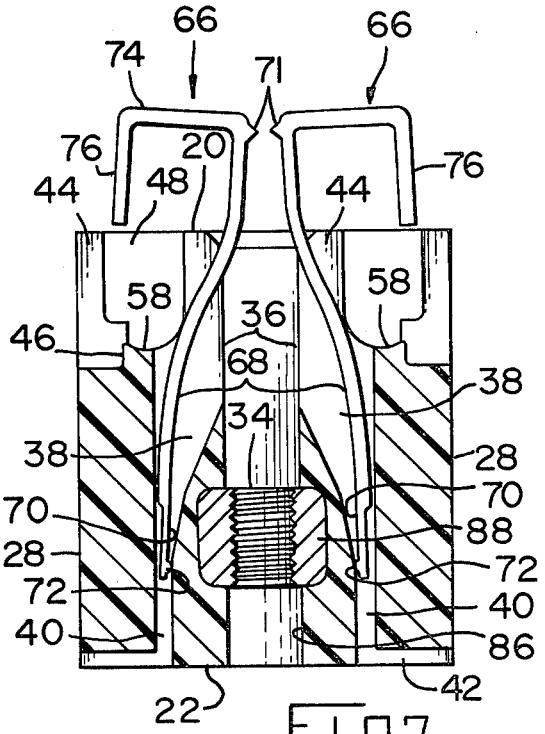
FIG. 7 is a cross-sectional view showing the manner in which the terminals are assembled to the connector housing.

The terminals are assembled to the insulating housing as shown in FIG. 7. Prior to assembly of the camming rods to the housing, a terminal is moved downwardly through each of the cavities and through the reduced lower portions 40 of the cavities until the end portion 70 of each terminal extends past the lower surface 22 of the housing. Thereafter, the end portion 70 is bent laterally outwardly so that it is in alignment with one of the recesses or slots 42 on the lower surface of the housing. Thereafter the camming rods 52 are passed through the openings 48. When each terminal is inserted into its associated cavity, the lower end of the tip portion 76 will bear against, and be preloaded against the outwardly facing shoulder 46 of the cavity, as clearly shown in FIGS. 2 and 8.

Figure 8:
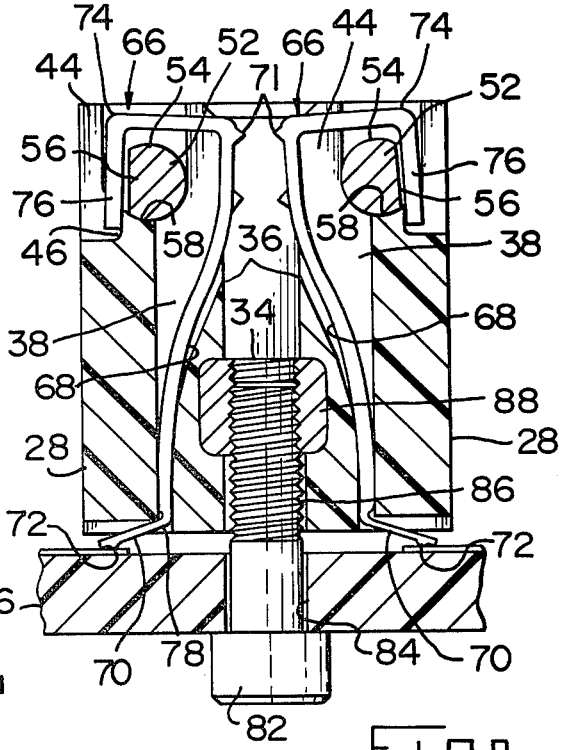
FIG. 8 is a view similar to FIG. 7 showing the manner in which the connector is assembled to the printed circuit mother board.

The connector is assembled to the panel member 16 by aligning an integral pilot 80 which extends from the lower surface 22 with an opening in the panel 16 and pushing the pilot 80 partially through the opening until the connector housing is in the position of FIG. 8. Thereafter, mounting and clamping screws 82 are passed through openings 84 in the panel 16, moved into openings 86 extending into the lower major surface 22 and the threads on the mounting screws are threaded into an insert 88 which is part of the housing. The insert may comprise a continuous bar of high strength material extending through the housing and between the endwalls and is provided with threaded openings for reception of a plurality of the clamping screws 82. Upon tightening of the clamping screws 82, the connector housing will be drawn downwardly from the position of FIG. 8 until it is in the position of FIG. 2 in which the end portions 70 of the terminals will be resiliently biased with a high contact force against the terminal pads or conductors 12 on the surface 14 of the panel 16.

The connector mounting and clamping arrangement described briefly above, of using a reinforcing bar in the housing in combination with clamping screws, is described more fully in application Ser. No. 344,438, filed on the same date as the instant application.

In use, and when it is desired to insert the panel member 8 into the connector, the camming rods 52 are rotated to the position shown in FIG. 3 so that the chordal surfaces 56 of the camming rods 52 are against the stop shoulders 50. During such movement, the camming rods will engage the tip portions 76 of the terminals and move the terminals out of the recesses 30 so that the contact portions 71, 71*a* will be moved inwardly beyond the surfaces 36 of the recess sidewalls. The panel member 8 can then be positioned in the recess 30 under zero insertion force conditions and, as mentioned above, the panel can be either moved downwardly from the position shown in FIG. 1, or laterally into the recess 30 from the righthand end thereof, as viewed in FIG. 1.

The camming rods 52 are then rotated through angles of 90° in opposite directions until they are in the positions of FIG. 4 in which the chordal surfaces 56 are against the shoulders 51. The camming rods, during this movement, are disengaged from the tip portions 70 of the contact terminals and the contact portions 71, 71*a* of the terminals thereby move against the conductors 4, 4*a* on the surfaces 6, 6' of the panel member 8. It will be apparent from a comparison of FIGS. 2 and 3 that the contact portions of the terminals will be held against the conductors on the panel member with a force resulting from the fact that the spring arm portions 68 of the terminals are prevented from returning to their normal positions of FIG. 2. The terminals should be tightly gripped in fulcrum locations in the constricted portions of the cavities 40 for best results.

An advantageous feature of a connector in accordance with the invention is that the rotary cams 52 are relatively remote from the fulcrum locations of the contact terminals. That is, the cams are remote from the area in which the terminals are securely held in the housing. The terminals are held or secured in the constricted portions 40 of the cavities and the portions of each terminal extending above the constricted portion of the cavity serves as a cantilever spring arm. These cantilever spring arms are flexed from the positions of FIG. 2 to the positions of FIG. 3 by applying the forces at locations remote from the lower ends of the terminals. It follows that, other things equal, relatively lower forces need be applied to the terminals to bring about the flexure of the terminals because of the fact that the spring arms are relatively long. This feature of the invention in turn gives rise to advantages which are particularly important for high contact force connectors requiring a large number of contact terminals on closely spaced centers. For example, the contact terminals can be relatively stiff and in the disclosed embodiment are in fact flat stamped members capable of producing high contact forces because of their relative stiffness. The contact terminals are also preloaded when in the positions of FIG. 2 and the contact forces result from the fact that the terminals tend to return to their normal positions of FIG. 2 but they engage the conductors on the surfaces of the panel 8 and are thereby restrained by the panel member. The contact forces are, therefore, developed in the terminals and the cams do not function to hold or clamp the terminals against the circuit board, as in many ZIF connectors.

A very limited but effective wiping action of the contact portions 71, 71*a* is achieved when the panel member 8 is inserted into the recess 30 and the cams are thereafter rotated. Since the upper ends of the terminals flex arcuately, they will have a vertical component of movement when they engage the conductors 4, 4*a*. The wiping action can be emphasized if the cams are individually rotated slightly from their positions of FIG. 4 and then returned to their FIG. 4 positions after insertion of the board. Such wiping is desirable in that it ensures good contact with the conductors 4, 4*a*.

A specific embodiment of the invention has been designed having contact terminals stamped from beryllium copper stock having a thickness of about 0.6 mm, the terminal housing containing a total of 156 terminals on each side of the recess 30. The center-to-center spacing of the terminals is 1.27 mm and the overall length of the connector housing is only 240 mm. The particular connector being described has an overall height of about 17.5 mm and a width of about 15 mm. Notwithstanding the tight spacing of the terminals and the dimensions of the connector, the contact force for each terminal can be 125 grams or greater.

The principles of the invention can, of course, be used for ZIF connectors intended for panel members 8 having conductors 4, 4*a* on only one surface thereof. A connector for a single sided circuit board would be only a single row of terminals in the housing and only a single cam shaft would be required.

What is claimed is:

1. A zero insertion force multi-contact electrical connector for connecting a mother panel board and a daughter panel board comprising an insulated housing having an upper major surface, a lower major surface for mounting on the surface of a mother board, opposed sidewalls and opposed endwalls, a trough-like recess extending into said upper major surface between said endwalls and parallel to said sidewalls for receiving edge portions of a daughter board, a plurality of side-by-side cavities divided therebetween by barrier walls on at least one side of said recess extending from said recess towards an associated sidewall, each cavity to receive a contact terminal inserted therein, contact terminals insertable into said cavities and securable to said housing proximate said lower major surface, said terminals for electrically engaging respective conductors on said mother and daughter boards, openings in said barrier walls on said at least one side of said recess for receiving a camming rod insertably therethrough extending from one endwall to the other parallel to said recess proximate said upper major surface, holding means on each endwall for holding a camming rod inserted therein, a camming rod insertable through said openings in said barrier walls on said at least one side of said recess and securable in said holding means, said camming rod being rotatable to cammingly engage said terminals away from said recess for placing a daughter board therein under zero insertion force conditions, characterized in that:

each cavity extends from said upper major surface towards said lower major surface and from said recess laterally toward an associated sidewall and having an enlarged upper portion and a lower portion reduced in cross section, said upper portion having an outwardly facing shoulder proximate an associated sidewall;

each terminal has a spring arm portion, a first contact portion adjacent an upper end of said spring arm portion for engaging a respective conductor on said daughter board, a bight section extending laterally from said upper end of said spring arm portion towards an associated sidewall, a tip section depending substantially vertically from said bight section which tip section is cammingly engageable by an associated said camming rod, said tip section having a lower end bearing against said outwardly facing shoulder of said cavity upon insertion of said terminal into a respective said cavity such that said upper end of said spring arm is normally extending into said recess, said terminal being tightly gripped in said lower portion of said cavity, and said terminal having a lower end extending past said lower major surface of said housing upon insertion and securable to said housing, said lower end having a second contact portion on said lower end for engaging a respective conductor on said mother board;

said camming rod has a longitudinal chordal surface portion and a cylindrical surface portion;

said camming rod is insertable in said housing after said terminals have been inserted into said cavities being partially surrounded by said tip sections and said bight sections of said contact terminals;

said openings of said barrier walls have surface portions which support portions of said arcuate surface of an associated said camming rod during rotation thereof.

2. A zero insertion force multi-contact electrical connector as set forth in claim 1 characterized in that said lower portion of each one of said cavities includes a fulcrum location proximate to said second major surface for tightly receiving and gripping a portion of a said contact terminal.

3. A zero insertion force multi-contact electrical connector as set forth in claim 1 characterized in that said holding means cooperatively hold an associated said camming rod after insertion thereof into said housing, against axial and lateral movement thereof while permitting rotational movement thereof.

4. A zero insertion force multi-contact electrical connector as set forth in claim 1 characterized in that said surface portions of said openings of said barrier walls are arcuate having a radius equal to said radius of said associated camming rod.

5. A zero insertion force multi-contact electrical connector as set forth in claim 1 characterized in that said connector has a first stopping means to stoppingly engage the chordal surface of an associated said camming rod when said camming rod has been rotated to cam said contact terminals to a position allowing placement of a daughter board in said recess under zero insertion force conditions.

6. A zero insertion force multi-contact electrical connector as set forth in claim 5 characterized in that said first stopping means comprises upwardly facing shoulders of said barrier walls proximate said camming rod.

7. A zero insertion force multi-contact electrical connector as set forth in claim 1 characterized in that said connector has a stopping means to stoppingly engage the chordal surface of an associated said camming rod when said camming rod has been rotated to allow said contact terminals to return to a position whereat they are not cammingly engaged by said camming rod.

8. A zero insertion force multi-contact electrical connector as set forth in claim 7 characterized in that said second stopping means comprises recess-facing shoulders of said barrier walls proximate said camming rod.

9. A zero insertion force multi-contact electrical connector as set forth in claim 1 characterized in that on said at least one side of said trough-like recess said first contact portions of alternate ones of said contact terminals are closer to said first major surface of said housing than the first contact portions of the remaining ones of said contact terminals on the same side of said recess, said connector being intended for use with a daughter board having conductors which are on a staggered pattern.

10. A zero insertion force multi-contact electrical connector as set forth in claim 1 characterized in that said cavities are located on each side of said trough-like recess and contain said contact terminals for electrically engaging respective conductors on both sides of edge portions of a two-sided daughter board.

11. A zero insertion force multi-contact electrical connector as set forth in claim 1 characterized in that said cavities are located on only one side of said recess and contain contact terminals for electrically engaging respective conductors on one side of edge portions of a one-sided daughter board.

12. A zero insertion force multi-contact electrical connector as set forth in claim 1 characterized in that said contact terminals are flat stamped members having their parts lying in the plane of the stock metal from which they were stamped.

13. A zero insertion force multi-contact electrical connector as set forth in claim 1 characterized in that each said camming rod is a metallic camming rod having an insulating coating on its surfaces.

14. A zero insertion force multi-contact electrical connector as set forth in claim 1 characterized in that said trough-like recess extends to and through at least one of said endwalls of said housing whereby a daughter board can be inserted into said recess at the said one of said endwalls and moved through said recess to the other of said endwalls of said housing.

* * * * *